US005829241A

United States Patent [19]

McAllister et al.

[11] Patent Number: 5,829,241

[45] Date of Patent: Nov. 3, 1998

[54] UNIFORM ALTERNATE PLY-TWISTED YARN

[75] Inventors: Robert William McAllister, Wilmington, Del.; Steven Kikuo Shibata, Salisbury, Md.

[73] Assignee: E. I. duPont de Nemours and Company, Wilmington, Del.

[21] Appl. No.: 597,557

[22] Filed: Feb. 2, 1996

Related U.S. Application Data

[63] Continuation of Ser. No. 213,899, Mar. 16, 1994, abandoned.

[51] Int. Cl.[6] ..... D01H 13/26; D02G 3/02

[52] U.S. Cl. ..... 57/204; 57/236; 57/293; 57/297

[58] Field of Search ..... 57/204, 205, 293, 57/294, 297, 333, 350, 236

[56] References Cited

U.S. PATENT DOCUMENTS

| | | | |
|---|---|---|---|
| 3,434,275 | 3/1969 | Backer et al. | 57/204 |
| 3,468,120 | 9/1969 | Hilebrand | 57/293 |
| 3,775,955 | 12/1973 | Shah | 57/293 |
| 4,074,511 | 2/1978 | Chambley et al. | 57/293 |
| 4,084,400 | 4/1978 | Movshovich et al. | 57/293 |
| 4,123,893 | 11/1978 | Chambley et al. | 57/204 |
| 4,246,750 | 1/1981 | Norris et al. | 57/293 |
| 4,276,740 | 7/1981 | Chambley et al. | 57/205 |
| 4,873,821 | 10/1989 | Hallam et al. | 57/293 |
| 5,012,636 | 5/1991 | Hallam et al. | 57/293 X |
| 5,179,827 | 1/1993 | Tinsley et al. | 57/293 |

*Primary Examiner*—William Stryjewski

[57] ABSTRACT

A process and apparatus for making alternate S and Z twist plied yarn from individual singles yarns includes the steps of tensioning the singles yarns as they move in a path through the process, twisting the individual yarns in either an S or Z direction, snubbing the yarn to restrain ply twisting so the twist in the singles yarn can equalize itself, stopping the forward movement of the yarn, then bonding the ply-twisted yarns at a node while applying twist, stopping the twisting operation, then repeating the procedure while twisting in the opposite direction. The ply twisted yarn has a lower defect level of less than 2.5 defects per 100 inch length of yarn.

1 Claim, 11 Drawing Sheets

L3b
36
L3a
L3a'
L2
12a
12
20
22
34
30
28
17
18
19
32

UNIFORM ALTERNATE PLY-TWISTED YARN

This is a continuation of application Ser. No. 08/213,899 filed Mar. 16, 1994, now abandoned.

BACKGROUND OF THE INVENTION

The invention relates to alternate twist plied yarn where the singles strands are twisted in the same direction and are brought together and allowed to spontaneously ply together until the singles twist torque is balanced by the ply twist torque. The single strands are bonded together in the region where the singles twist reverses and they may be bonded in the plied yarn before the singles twist is reversed.

U.S. Pat. No. 4,873,821 describes a process where the alternate ply twisted yarns are bonded in the ply twisted condition before the singles twist is reversed. These yarns can be made with very short bonds (less than 5 times the plied yarn diameter) since there is at least one good cross-over where strong bonding can occur. The singles twist reversal length in such yarns is very short (less than 1 times the plied yarn diameter) and it occurs at one end of the bond. Yarns made in this manner, however, are allowed to spontaneously ply together at a short distance from the exit of the twisting means so there is no significant distance over which any variations in singles twist can equalize. It has been found to be difficult to uniformly produce singles twist along the strand length since the twisting means most often employed are friction devices or fluid jet devices that inherently have relative slippage with the yarn and therefore have some variability in their twisting effect on the singles strands. The speed of the singles strands through the twisting means may also be variable so even a constant twisting rate results in uneven distribution of twist along the length of the singles yarn. Variations in singles twist results in variations in ply twist when two twisted singles are allowed to spontaneously ply together. This may produce defects in the form of sections of ply twist that vary excessively above or below the average ply twist of the yarn. When used to make carpets, yarns having sections of excessively low or high ply twist may appear as streaks in the carpet. There is also a defect called flashes caused by excessive twist imbalance in the yarn where at least one strand has a high singles twist and the other strands have low singles twist or vice-versa. This defect can be visually detected in the plied yarn where at least one strand appears loose and bulky compared to the other strands. Flashes may show up as a streak in a carpet.

There is a need for a system for making alternate ply twist yarns that will produce a package of yarn having a bond in the ply twisted yarn and a ply twist reversal at one end of the bond and having a uniform ply twist between bonds where the expected number of defects per 100 inch length of yarn is much lower than known alternate twist plied yarns, that have been found to have defect levels exceeding 5 defects/100 inch length. There is also a need for a high speed process for making alternate twist plied yarn where the defect level remains low.

SUMMARY OF THE INVENTION

The invention is an alternate twist plied yarn formed from a plurality of strands ply twisted in alternating directions in lengthwise intervals of first half-cycles of ply-twist followed by second half-cycles of ply-twist with reversal nodes therebetween and having a average ply twist level measured as the average number of twist plys per inch over a sample length of at least 10 consecutive half-cycles and at least 500 inches, there being a bond formed adjacent each node wherein the first half-cycle of ply-twist is located within the bond and the second half-cycle of ply-twist originates at one end of the bond, said alternate twist plied yarn having an expected defect level of less than 2.5 defects per 100 inch length of twist plied yarn, said defect rate including the total of high ply twist defects, low ply twist defects, and unbalanced singles twist defects over said sample length.

The invention is also a process for making an alternate twist plied yarn formed from a plurality of strands by advancing the strands at a predetermined rate under tension in a path adjacent to each other; twisting the strands in a predetermined manner as they advance along the path; ply twisting the twisted strands to form a first half-cycle length of ply twist; stopping the forward motion of the strands; bonding the ply-twisted strands to form a bond; stopping the twisting of the strands; then repeating the steps while twisting the strands in a different manner to form a second half-cycle of ply twist, the improvement comprising; snubbing the strands to restrain the ply twisting over said half-cycle lengths so that the twist in the singles strands is able to redistribute over the strand lengths.

The invention is also an apparatus for forming bonded alternate twist plied yarn from a plurality of strands having a distance between twist reversal nodes defining sections of alternate twist in the yarn and bonds in the plied yarn adjacent thereto, the apparatus comprising: a source of supply of the strands; means for tensioning the strands; means for twisting the strands in alternating directions; a means for bonding said plied strands before reversing said twisting; means for forwarding said yarn; and means for snubbing the strands located between the means for twisting the strands and the means for forwarding said yarn to restrain plying of the yarns, the distance between the means for twisting the strands and the means for snubbing the strands being less than the distance between twist reversal nodes.

DETAILED DESCRIPTION

Figure 1:
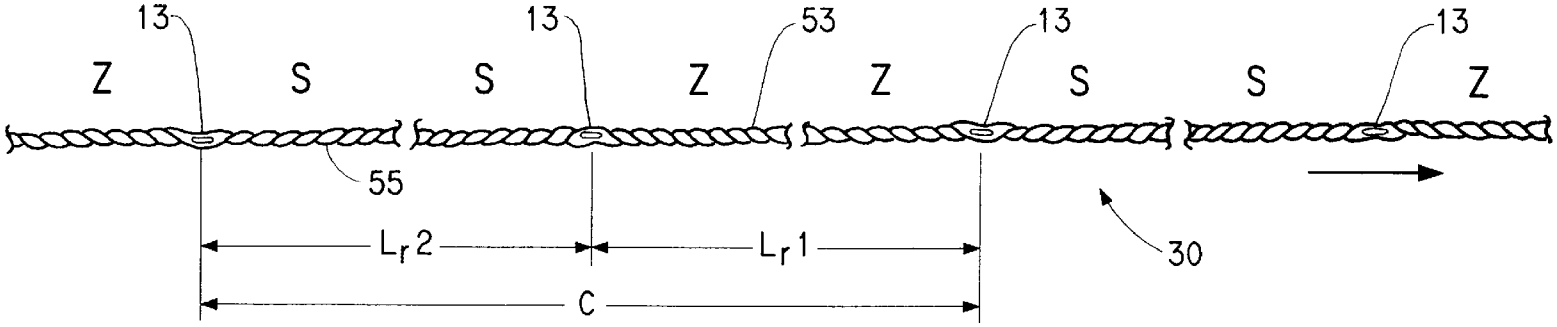
FIG. 1 is a schematic view of alternate twist plied yarn.
Figure 2:
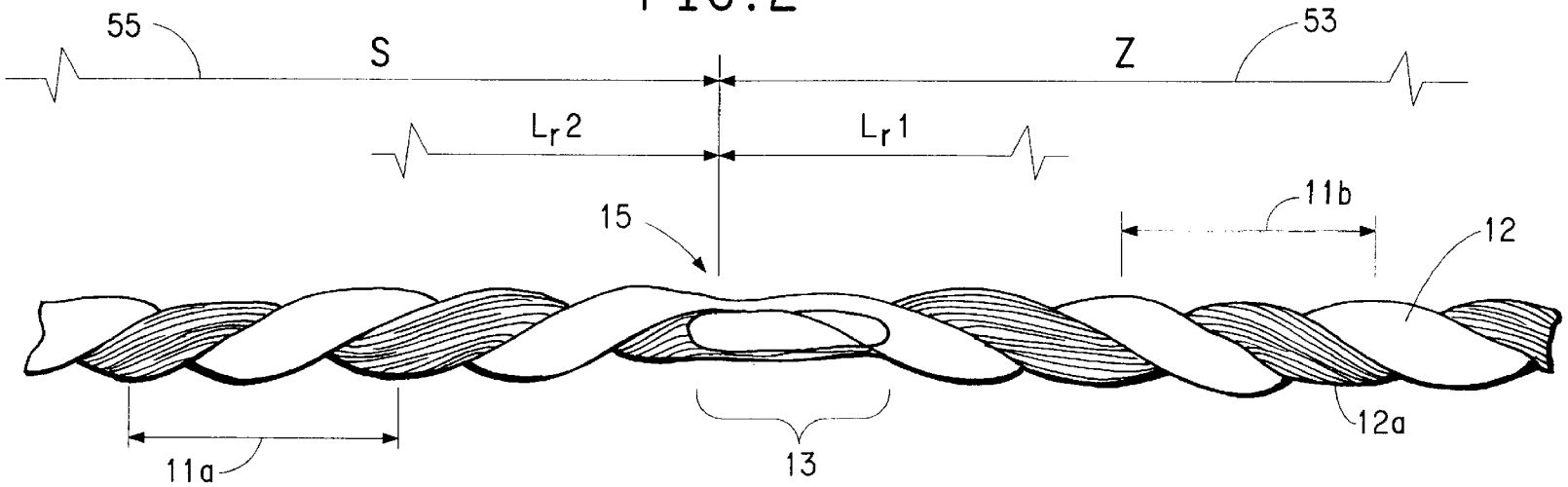
FIG. 2 is an enlarged view of a portion of the yarn of FIG. 1.

FIG. 1 shows a segment of alternate twist plied yarn comprised of alternating sections of S ply twist and Z ply twist, such as sections 55 and 53 respectively. The S and Z ply twist sections are separated by bonds 13 in the ply twisted yarn, and reversal nodes adjacent one end of the bond. The distance between reversal nodes or bonds is the reversal length, such as Lr1 and Lr2. The distance C from one S-twist section to the next, represents one cycle of alternate ply twist with Lr1 representing a first half cycle of ply twist and Lr2 representing a second half cycle of ply twist. FIG. 2 shows an enlarged view of the yarn of FIG. 1 adjacent a bond 13 and reversal node 15. The ply twist of the first half cycle, Lr1, is "locked-in" within bond 13, and the ply twist of the second half cycle Lr2 originates at one end of the bond at reversal node 15. The yarn is comprised of two strands 12 and 12*a* that are plied together with a twist pitch 11*a* in the S section and twist pitch 11*b* in the Z section that represents the length of one turn of ply twist. For a perfectly uniform ply twisted yarn, 11*a* and 11*b* should be the same and should be constant along the length of the yarn. Such condition is very difficult to achieve in practice, particularly at speeds greater than 200 YPM that make the process commercially attractive. More than the two strands shown may be plied together, such as three strands, four strands or more. Preferably, the yarn is bulked and heat set after plying, particularly, if it is to be used in a cut pile carpet, so the cut strands will stay plied together.

Figure 3:
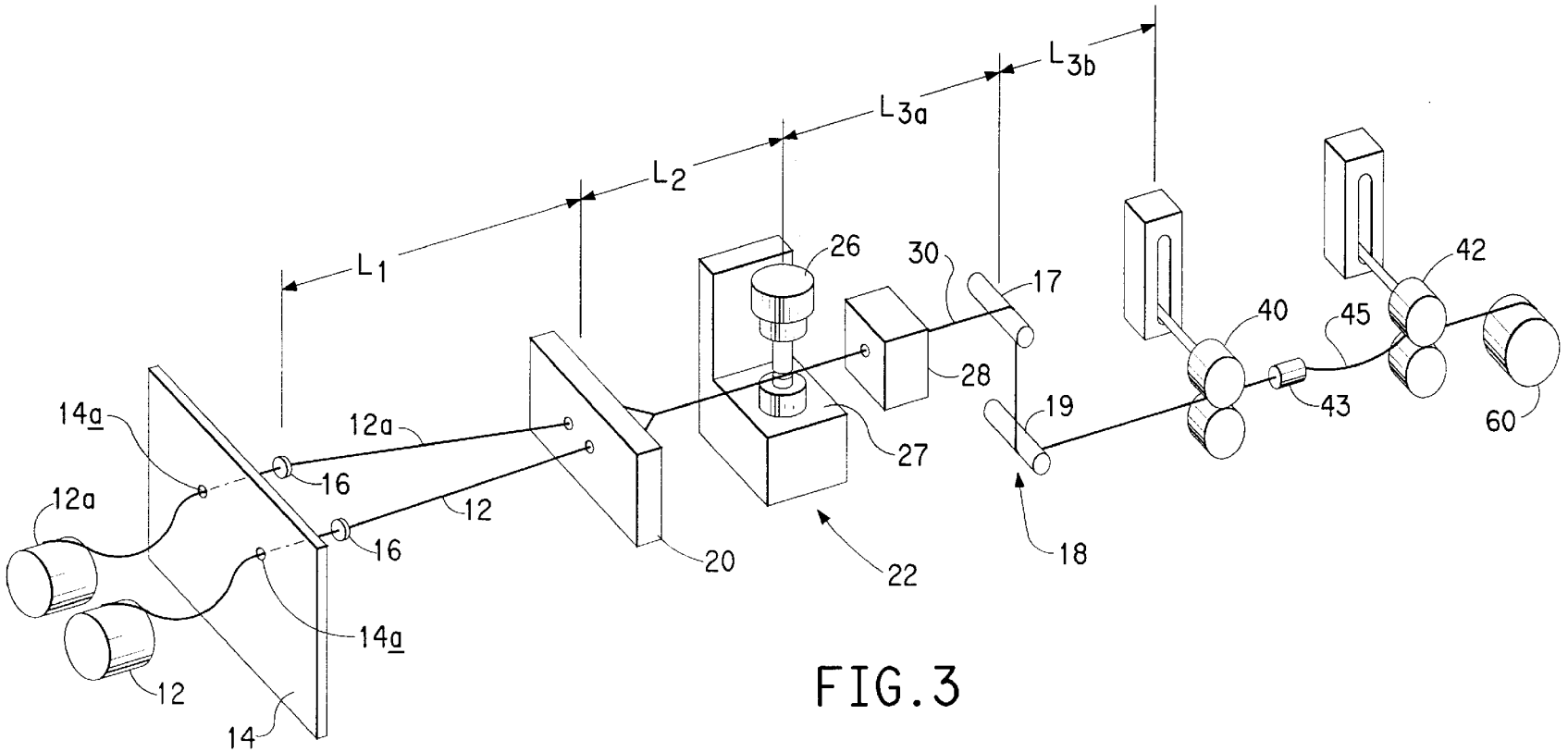
FIG. 3 shows a schematic view of the apparatus with an in-line ply snub.

FIG. 3 shows a typical layout of the apparatus and associated control features for alternate ply twisting of two yarns where the apparatus has a ply-twist snub 18 added. The layout is an improvement over that used in the apparatus and process described in U.S. Pat. No. 4,873,821, which is incorporated herein by reference. The yarn singles strands 12 and 12*a* are unwound and passed through holes 14*a*, in baffle board 14 and then through tensioners 16, before entering torque jet 20. The yarns are twisted after exiting the torque jet 20 and they may then ply together into a plied yarn strand 30 that passes through bonder 22 and booster torque jet 28. The booster jet serves to assist the torque jet in generating singles twist so slightly higher ply twisting is achievable. During bonding, the booster jet overplys the yarn adjacent the bonder so multiple crossovers occur for reliable strong bonding. The plied strand 30 then passes through ply-twist snub 18 introduced near booster torque jet 28 and between the booster torque jet 28 and pull rolls 40 that pull the yarn through the system, stopping and starting to allow periodic bonding. Nip rolls 42 are driven at a constant speed to forward the yarn for further processing, such as winding. To reduce tension fluctuations between rolls 40 and 42, aspirator jet 43 is used to strip yarn from pull rolls 40 and feed it into a low tension or tensionless loop 45 before winding the yarn at constant speed into package 60.

The distance between the tensioner 16 and the torque jet 20 forms a zone designated L1 where the singles yarns are free to twist. The distance between the torque jet 20 and the bonder 22 forms another zone designated L2 where the singles strands are usually allowed to converge and ply together before the bonder. The distance between the bonder 22 and the pull rolls 40 forms a zone having two portions designated L3*a* and L3*b* where the plying of the singles yarns may take place. In zone L3*a*, restrained plying takes place and the zone is preferably less than one reversal length long and no more than one bond is present in the zone. In zone L3*b*, essentially unrestrained plying takes place, and the zone is preferably more than two reversal lengths long and there are two or more bonds provided in this zone, the bonds separating alternate twist portions of strand 30. This provides for alternating rotation and plying of strand 30 in this zone.

Ply-twist snub 18 comprises two closely spaced pins 17 and 19 that guide the yarn through two angled turns, such as two 90 degree turns, so the yarn continues in-line. The ply-twist snub restrains rotation of plied strand 30 while in contact with pin 17 due to frictional engagement with the pin surface. By restraining is meant resisting, working against, opposing, or limiting; it does not necessarily mean preventing yarn rotation and plying but it may include that. Such ply-twist snubbing could also be accomplished by omitting pin 19 and passing yarn 30 for 360 degrees around pin 17; pin 17 may then need to be mounted in rotary bearings for free rotation to decrease the friction of the yarn on the pin that may unduly increase tension in the yarn in zone L3*b*. Pins 17 and 19 could also be replaced with two eyelets or pigtail guides or the like. Ply twist snubbing restrains or inhibits, or in some cases stops, the rotary movement of the traveling yarn upstream and immediately downstream of the snub.

When the ply-twist snub is absent, the singles freely ply together very near the exit of torque jet 20 assisted by booster torque jet 28. When plied together above about 2 TPI, the variations in singles twist and ply twist cannot redistribute easily along the yarn length. The singles twist is the predominant driver for the ply twist. Without the ply-twist snub, the distance over which the singles twist can redistribute is too short (in zone L2) for short term variations to be leveled. These short term variations on singles twist can produce three types of ply twist uniformity defects:

1) low ply twist—below average ply twist that may show up in a cut pile carpet as a streak where tuft definition is low.
2) high ply twist—above average ply twist that may show up in a cut pile carpet as a streak where the tufts have very low bulk.
3) unbalanced singles twist—at least one singles strand has very low singles twist that shows up in the yarn as a "flash" where at least one yarn appears loose and the others tight; and which may show up in a cut pile carpet as a streak where the low singles twist strand flares out.

FIGS. 4*a–d* show how the ply-twist snub acts to provide more uniform ply twist to the yarn 30. The ply-twist snub 18 provides zone L3*a*' where plying is restrained and maintained at a low level. When the plying is restrained and at a low level of turns per inch, the twist in the singles yarns 12 and 12*a* can redistribute as the low ply level yarn travels between booster torque jet 28 and ply-twist snub 18. This allows any variations of twist along short distances to level or equalize or redistributes over this longer distance of zone L3*a*'. The snub is believed to restrain rotation of the yarn as it tries to spontaneously ply resulting from the singles twist put in the yarn by torque jet 20. The booster jet 28 assists yarn plying between jet 28 and jet 20, and assists yarn unplying between jet 28 and snub 18. By locating the snub near the booster jet, the snub is most effective in restraining spontaneous ply rotation of the traveling yarn, and in aiding the booster jet in unplying the yarn by concentrating the effects on a short segment of traveling yarn. As the reversal/bond travels through the distance between the booster jet and the snub (zone L3*a*'), restraining rotation upstream of the bond is more difficult since the bond can easily rotate when there is a reservoir of S and Z twist available adjacent the reversal/bond. When the snub is near the booster jet, or torque jet if a booster is not used, the reservoir of yarn adjacent the bond is smaller so the snub is more effective. The result is that a low ply level is achieved and maintained in a snub zone L3*a*' between the booster jet 28 and the snub 18. The low ply level is preferably below about 2 TPI over a length of preferably about 4 inches or more so short variations in twist in the singles strands are able to redistribute. The effect of the snub in restraining plying is much less downstream of the snub between snub 18 and pull rolls 40 due to the absence of a booster jet and the much longer length of yarn in zone L3*b*. To achieve the improved ply uniformity of the new yarn of the invention, the distance between the booster jet 28 and snub 18 is preferably between 4" and 28", and is most preferably between 7" and 17". There are tradeoffs in locating the snub. A greater distance gives a larger averaging distance over which the singles twist can redistribute, which is good, but it provides a larger reservoir of yarn adjacent a bond in zone L3*a*', and it makes it harder for the booster jet to unply the yarn thereby permitting a higher TPI in the snub zone which is bad. A shorter distance provides a smaller reservoir of yarn adjacent a bond in zone L3*a*', and it makes it easier for the booster jet to unply the yarn and thereby provide a lower TPI in the snub zone which is good, but it shortens the averaging distance which is bad. Distances of 30" to 50" provided some improvement in ply uniformity over no snubbing, but did not provide the level of uniformity of the new product of the invention. The length of snub zone L3*a*' should always be less than the reversal length of the alternate twist plied yarn so there is never more than one reversal/bond in the snub zone. Commercially practical alternate twist plied yarns have reversal lengths usually exceeding 50" and most often exceeding 70". Snubbing can also improve ply uniformity in a system without a booster jet, but maximum benefits are obtained when a booster jet is used.

Figures 4A, 4B, 4C, 4D:
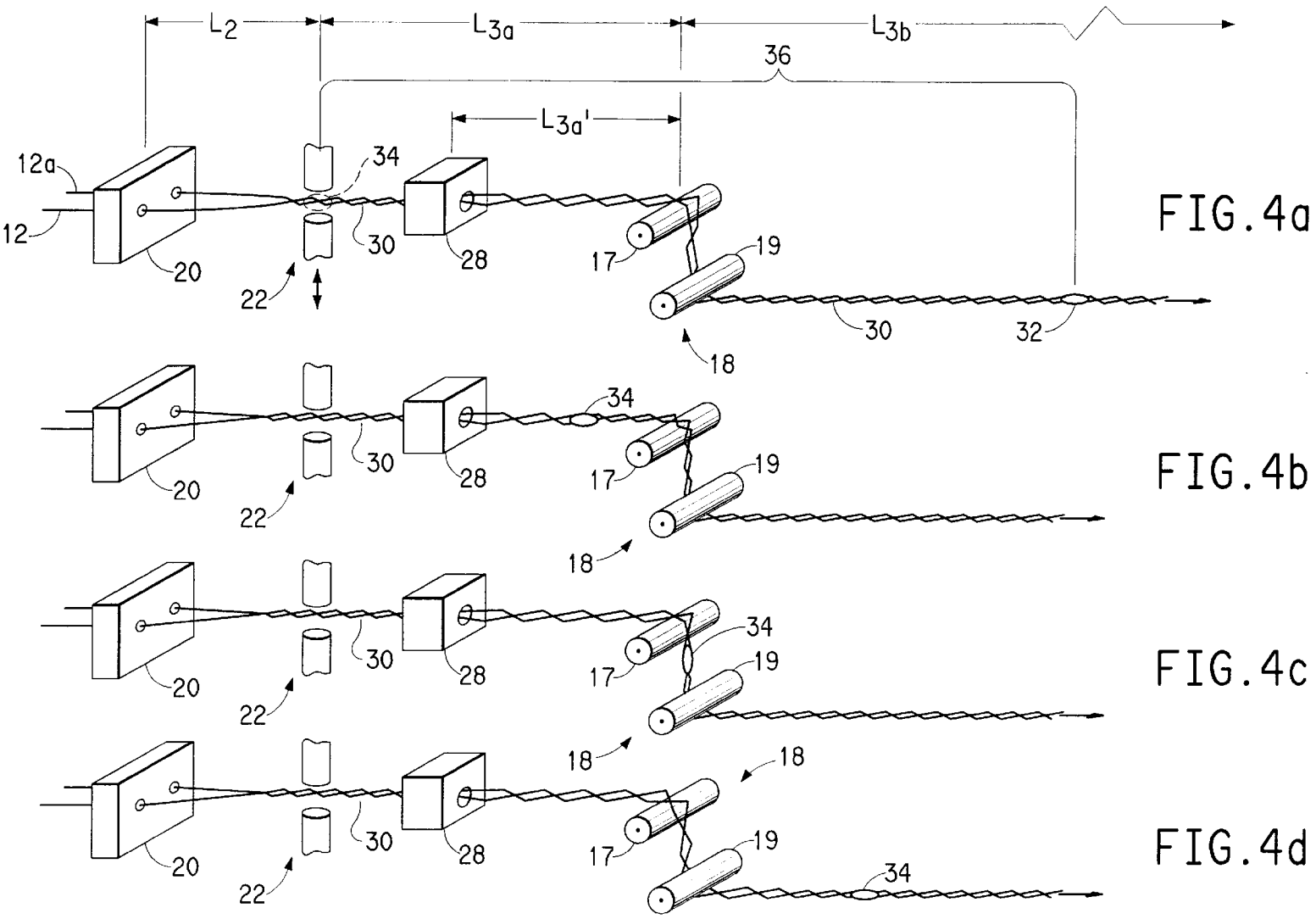
FIGS. 4*a*, 4*b*, 4*c*, and 4*d* are a sequence of elevation views of a portion of FIG. 3 schematically showing restrained ply segments of yarn as the yarn passes through the apparatus.

FIG. 4*a* shows the situation just before a bond 34 is to be made in the yarn after booster torque jet 28 forces plying to create cross-overs in the bond. The singles yarns 12 and 12*a* spontaneously ply together to form a first cycle of plied yarn 30 in zone L2 assisted by booster jet 28. Plied yarn 30 is restrained from spontaneously plying by snub 18 and is partially unplied by booster jet 28 in snub zone L3*a*', resulting in a low ply twist level here. The singles twist can redistribute or equalize in zone L3*a*' so that when the yarn enters zone L3*b*, the equalized singles twist can produce a more uniform ply-twist.

FIG. 4*b* shows the situation after a bond has been formed by energizing booster torque jet 28 to force the twisted singles strands to ply during the time the ultrasonic bonder 22 is energized. This forced plying is prefered to achieve numerous strand crossovers in the bond to make a strong, reliable bond. This process for strong, reliable bonding is described in co-pending U.S. application Ser. No. 08/072, 642 filed Jun. 8, 1993. The bond 34 has been released from the bonder and the singles twist reversed by torque jet 20 and booster jet 28 so that spontaneous plying begins to form a second cycle of plied yarn 30 in zone L2. As the bond passes through booster jet 28, partial unplying of the second half-cycle of ply twist by the booster jet begins, aided by the rotation restraint of the snub; or, alternatively, the rotation restraint of the snub is aided by the booster jet unplying.

In FIG. 4*c,* after the bond goes around pin 17, the rotation restraint of the snub is slightly more effective since the more easily rotatable reversal/bond is out of the snub zone.

In FIG. 4*d,* shortly after the reversal/bond has passed the snub, the ply twist level in snub zone L3*a*' has been observed to be less than about 2 TPI when making 4 TPI 2 ply yarn. The actual mechanism by which the snub lowers TPI and contributes to singles redistribution as the yarn rapidly travels through the system is not completely understood, but the improved ply uniformity is clearly evident when comparing snubbed yarn to unsnubbed yarn; and a heretofore unattainable uniformity can be achieved when the snub is located near the booster jet as described.

It has been found that use of a twist-stop may sometimes slightly inhibit ply-twisting, so to achieve the same level of ply-twist, the pressure level in torque jet 20 may have to be increased beyond what would be used if no twist-stop were present.

Figure 5:
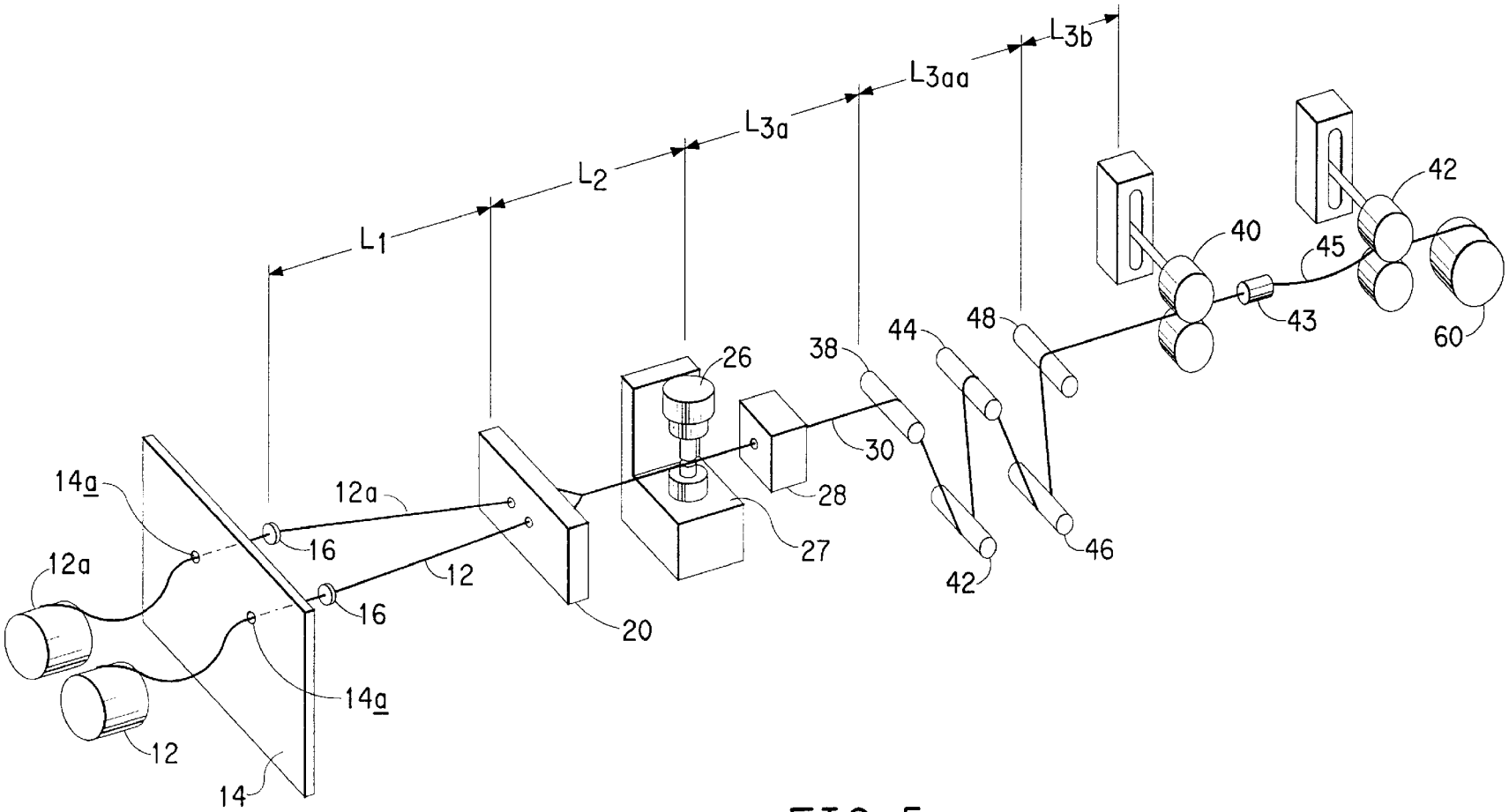
FIG. 5 shows a schematic view of the apparatus with multiple ply snubs.

FIG. 5 shows another embodiment of a twist-stop means comprising multiple ply snub pins 38, 42, 44, 46, and 48. The yarn path between pins 38 and 48 defines a zone L3*aa* where the ply-twisting is further restrained, the yarn rotation is restrained as it bends back and forth over the pins, and some additional singles twist equalizing can occur. The number of pins should be limited due to the possible tension build-up that may inhibit spontaneous ply-twisting in zone L3*b*. Rolls 40, 42 and aspirating jet 43 work together as described above in connection with FIG. 3.

Figure 6:
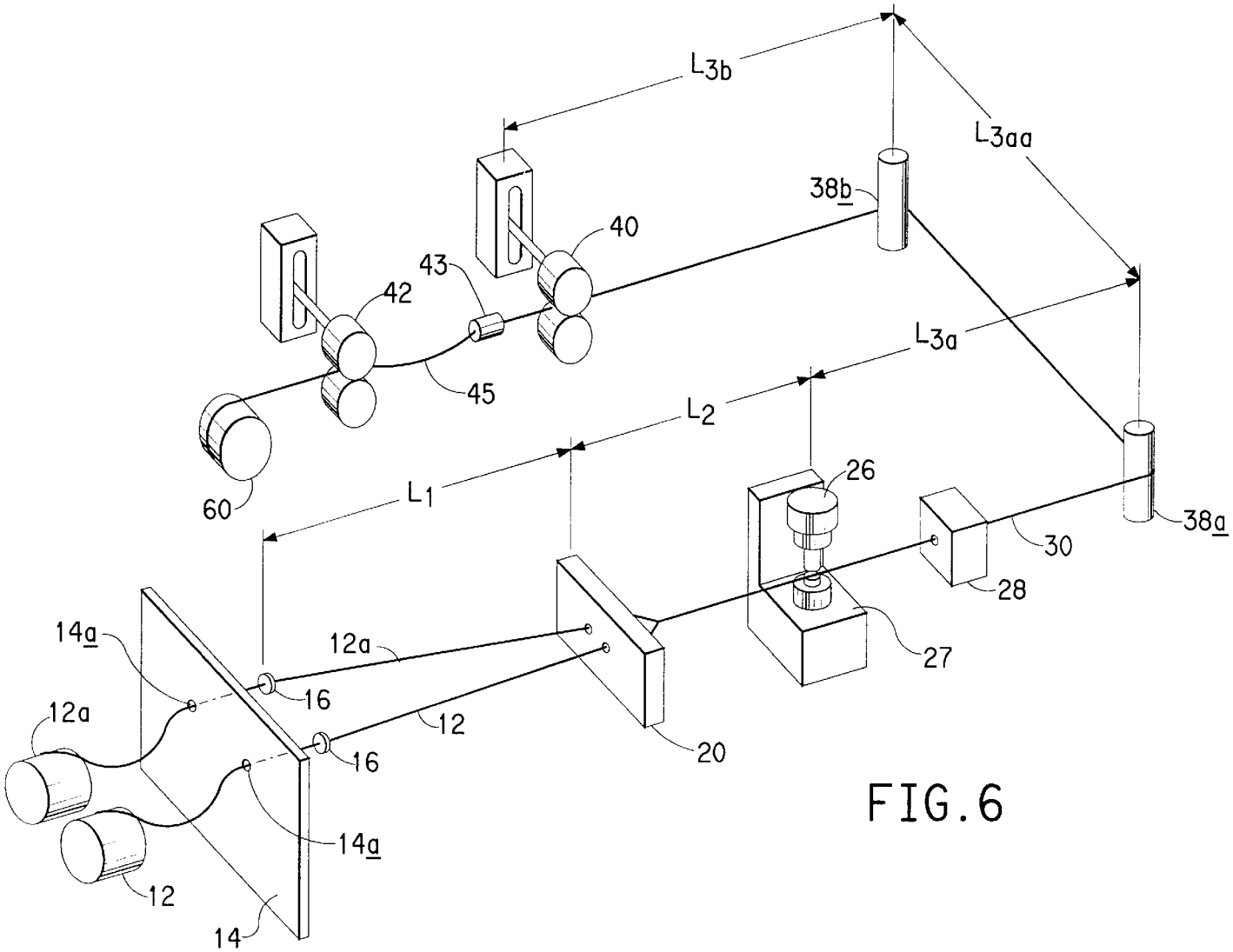
FIG. 6 shows a schematic view of the apparatus with right angle ply snubs.

FIG. 6 shows an arrangement of ply snub pins 38*a*, 38*b* that may also act as a means of changing the direction of the threadline so the process may be "folded" upon itself to result in a shorter process line. Again, rolls 40, 42 and aspirating jet 43 work together as described above.

Figure 7:
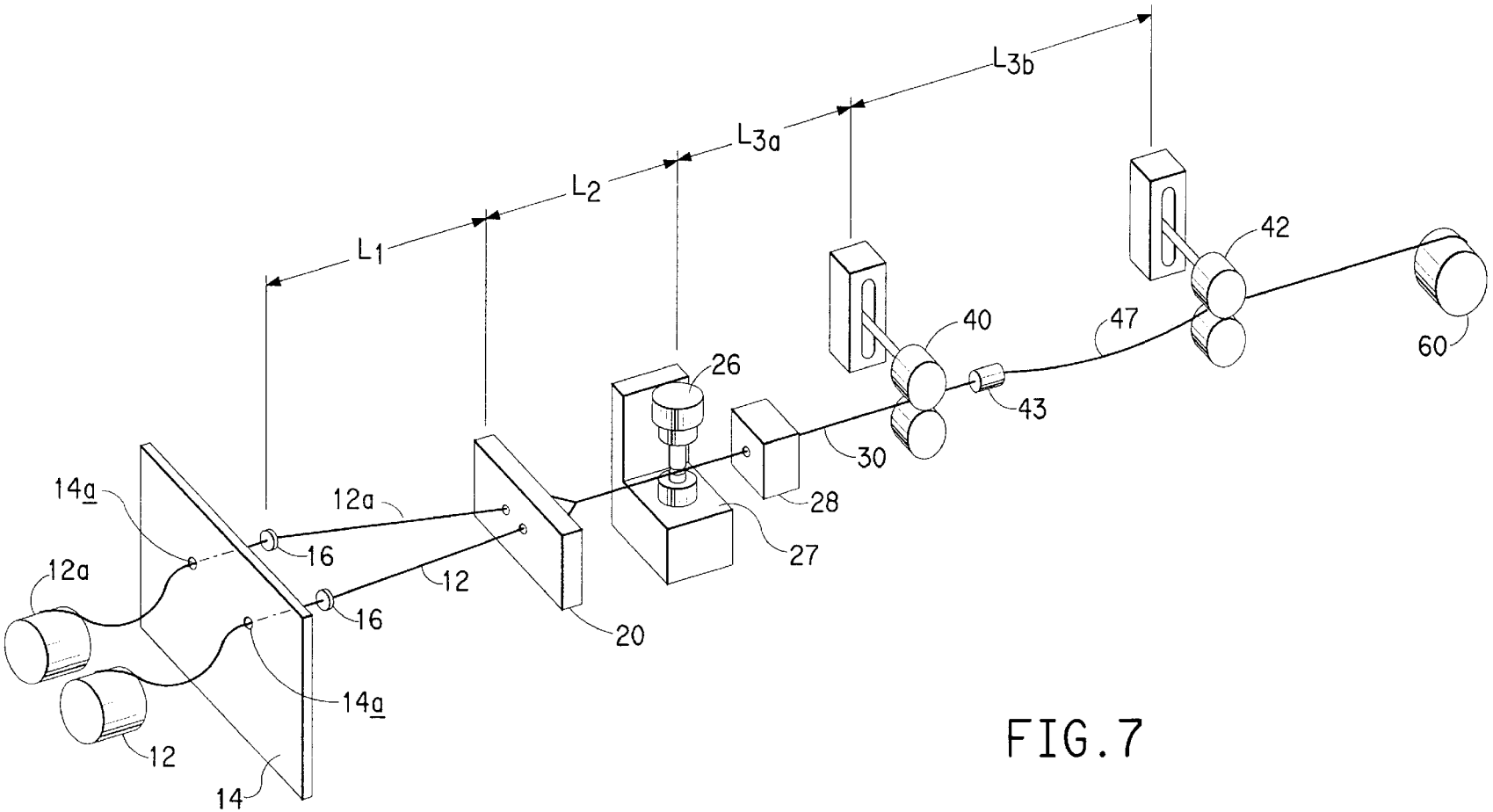
FIG. 7 shows a schematic view of the apparatus with a driven nip roll ply snub.

FIG. 7 shows another embodiment of a ply snub means comprising the pair of pull rolls 40 that pinch the yarn between them and thereby restrain rotation of the upstream threadline. The pull rolls 40 and jet 43 propel the yarn into an accumulation loop 47, before reaching nip rolls 42, where the yarn is free to ply together since, in this embodiment, the loop 47 preferably contains more than two reversal lengths of yarn. When the pull rolls 40 are used as a ply snub, they also act to axially stabilize motion of the yarn line 30 that is somewhat of an elastic-structure. This has the advantage that the distance between the driven pull rolls 40 and the torque 10, jet 20 in FIG. 7 is much shorter than the distance between pull rolls 40 and torque jet 20 in FIG. 3. It is believed that this shorter distance allows the motion imparted to the yarn by the nip rolls to be more directly coupled to the motion of the yarn at the torque jets without delay and damping caused by a long elastic section of alternate ply-twisted yarn. This decreases oscillating axial yarn motion at the torque jet as the yarn stops and starts for bonding; uniformly controlled motion of the yarn at the torque jet contributes to improved singles twist uniformity and thereby ply-twist uniformity. A problem observed when using nip rolls as a ply snub is that it is difficult for booster torque jet 28 to improve TPI levels and to force plying of the strands for bonding when the pull rolls are closed. This could be solved by periodically opening the pull rolls just at the moment the bond is being made. This could also be solved by the embodiment of FIG. 8.

Figure 8:
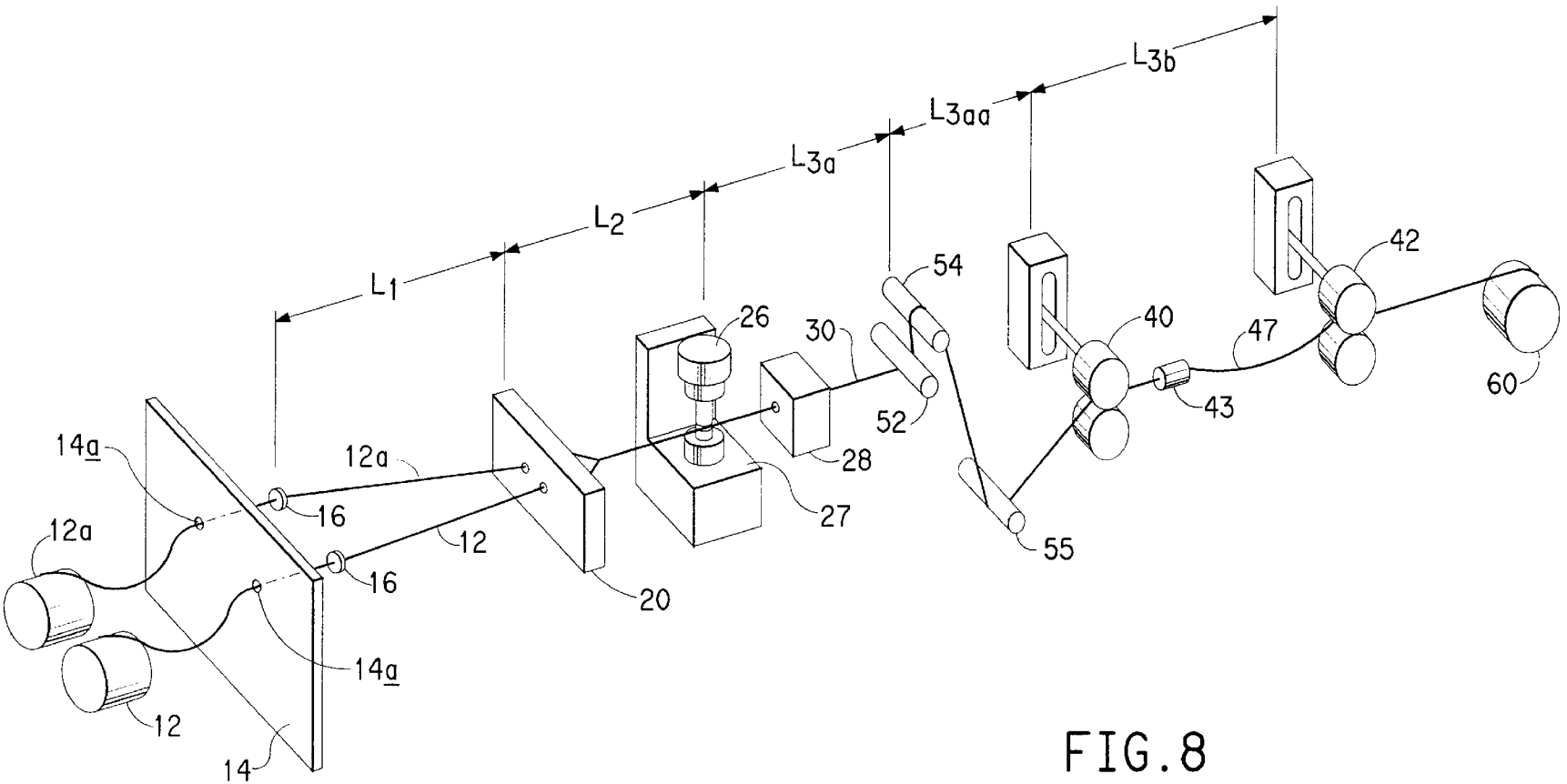
FIG. 8 shows a schematic view of the apparatus with an in-line ply snub and a driven nip roll ply snub.

FIG. 8 shows another embodiment that is a combination of ply snub pins and pull rolls. Ply snub pins 52, 54 and 55 are combined with pull rolls 40 that act as an additional snub, to provide an additional zone L3*aa* for further equalizing the singles twist. The pull rolls 40 also provide the advantage of a shorter distance between the torque jet 20 and the driving rolls 40, compared to FIG. 3, as discussed referring to FIG. 7. A large tensionless loop 47 is provided, as in FIG. 7, to permit unrestrained plying of the yarn to fully develop the final ply twist level.

The effectiveness of the various ply snub means in eliminating the low and high ply twist defects (defects 1 and 2 above) can be determined by measuring the ply-twist level in a plurality of increments between reversals for a given set of operating conditions. The ply-twist levels in turns per inch (TPI) in a sample that includes at least about 10 consecutive reversals (5S twist and 5Z twist plies) and 500 inches of yarn gives a good representation of the ply-twist condition to be expected in a package of yarn that may contain 2000 yards of yarn and include about 1000 reversals. One way to measure the TPI of the yarn is to measure the average TPI for a plurality of 5" segments and any partial segment between reversals using the device in FIG. 9. A 5 inch segment was chosen since it is believed that a non-uniform segment greater than this length would likely be visually detected in a residential style, cut pile, tufted carpet; shorter segments would be less apparent. Shorter segments may also result in a burdensome amount of data to be routinely collected.

Figure 9:
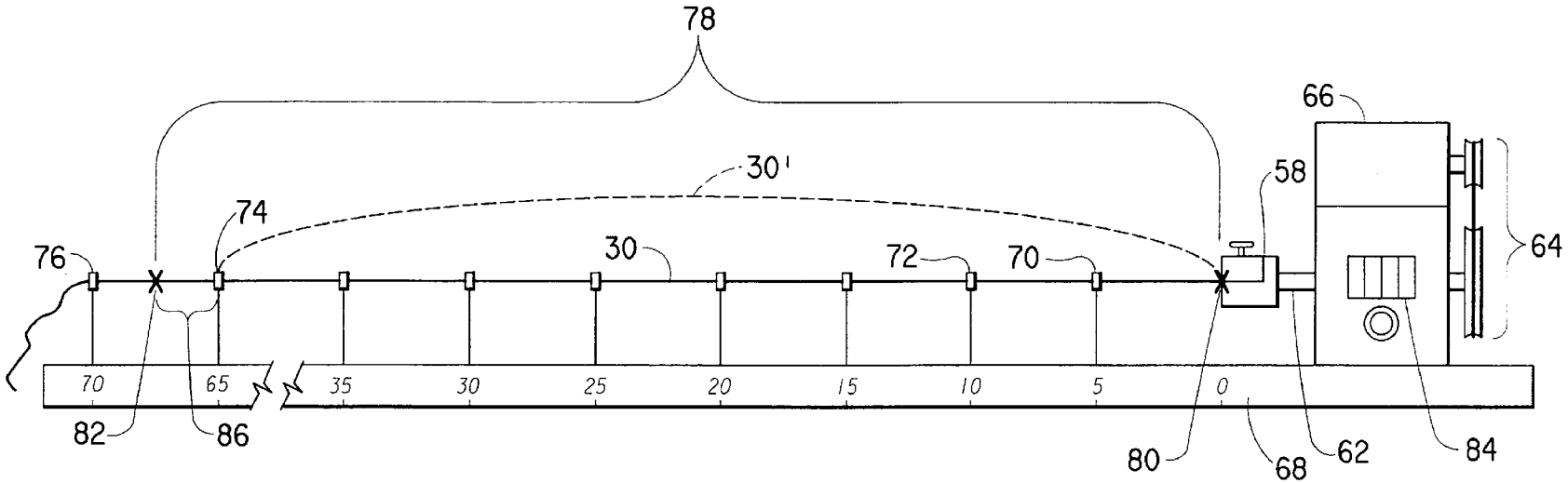
FIG. 9 shows an elevation view of an apparatus for measuring ply twist in short segments of yarn.

The ply-twist measuring device of FIG. 9 consists of a clamp 58 attached to a rotating shaft 62 driven by a pulley arrangement 64 powered by a motor 66. At regular intervals away from clamp 58 along base 68 are clips, such as yarn clips 70, 72, 74, and 76. A sample of alternate ply-twisted yarn 30 having a length 78 between bonded reversals 80 and 82 is placed in the device. Bond 80 is placed in clamp 58 and a portion of the sample, slightly longer than one reversal length is then clipped in all the clips at the regular intervals, which for the example shown is a 5 inch interval. The last clip is clip 76 just beyond the next bond 82. The device has a turns counter 84 that registers the turns of shaft 62.

To collect the ply-twist data, the counter is set to zero and the motor is engaged to rotate clamp 58 to untwist the ply in the sample which may be either an S or Z ply-twist. When the strands in the yarn are unplied and parallel to one another, the motor is stopped and the turns counter is read and the data which represents the number of turns of ply-twist in the first 5 inch interval is recorded. The counter is then reset to zero, the yarn is released from first clip 70, and the process is repeated to get the number of turns of ply-twist in the second interval between clip 70 and 72. This process continues until the yarn has been released and unplied up to, but not including, clip 74. To get the number of turns of ply-twist in the shorter interval 86 between clip 74 and bond 82, the interval 86 is measured and then bond 82 is grasped by the operator, the yarn is released from clip 74, and the bond 82 is placed in clip 74; the yarn is loosely held in the position shown by the dashed line 30' and the interval 86 of ply is untwisted. The turns data is converted to turns per inch by dividing the number of turns by the inches in each interval. Data for a particular set of operating conditions is gathered over at least 10 sequential reversals (5S and 5Z plies). To insure a significant length of yarn is evaluated when a short Lr is being made, the sample should also include at least 100 of the 5 inch segments or 500 inches of yarn.

Figure 10:
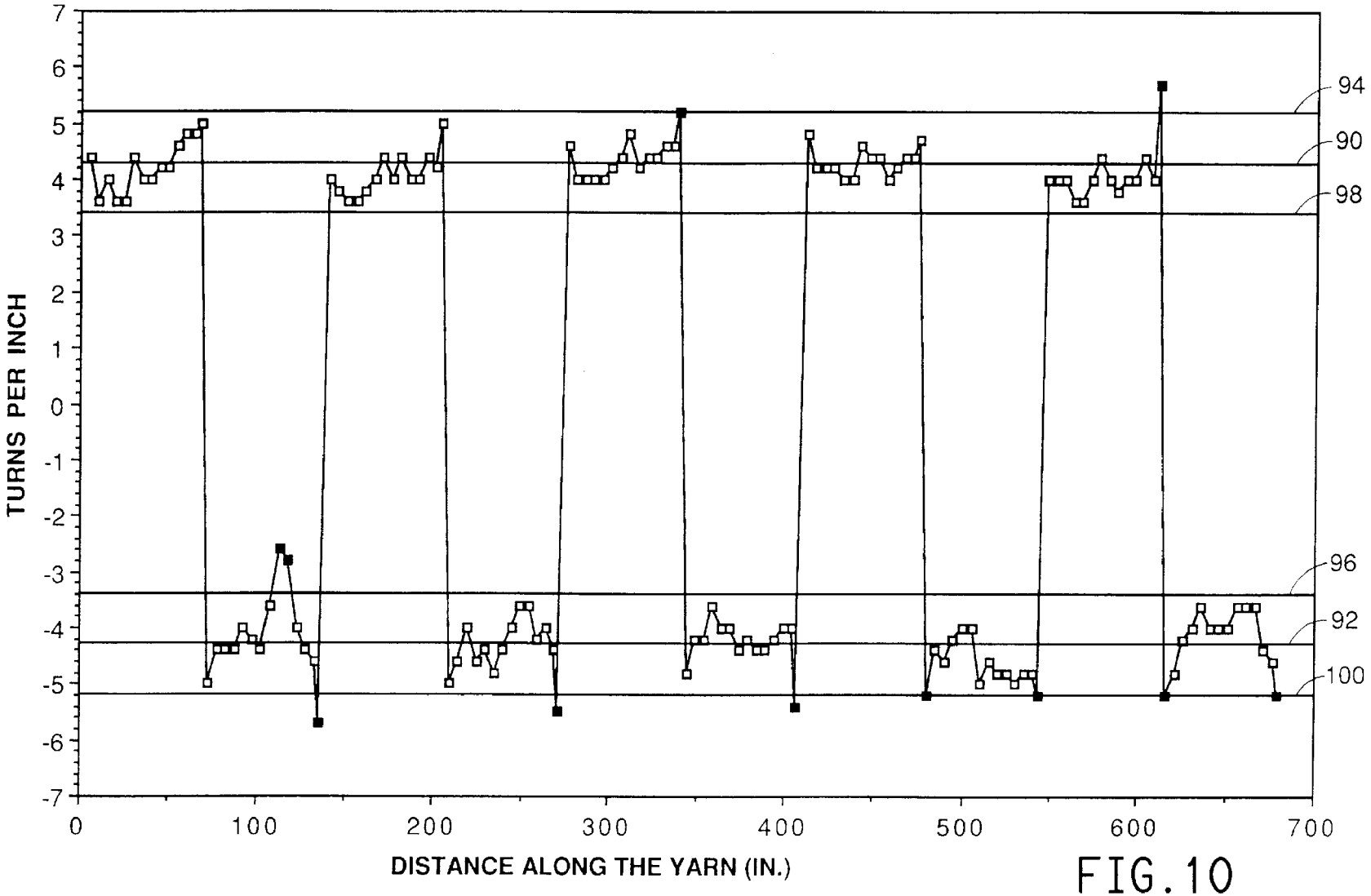
FIG. 10 is a plot of turns per inch (TPI) versus sample length for a sample yarn made with snubbing.
Figure 11:
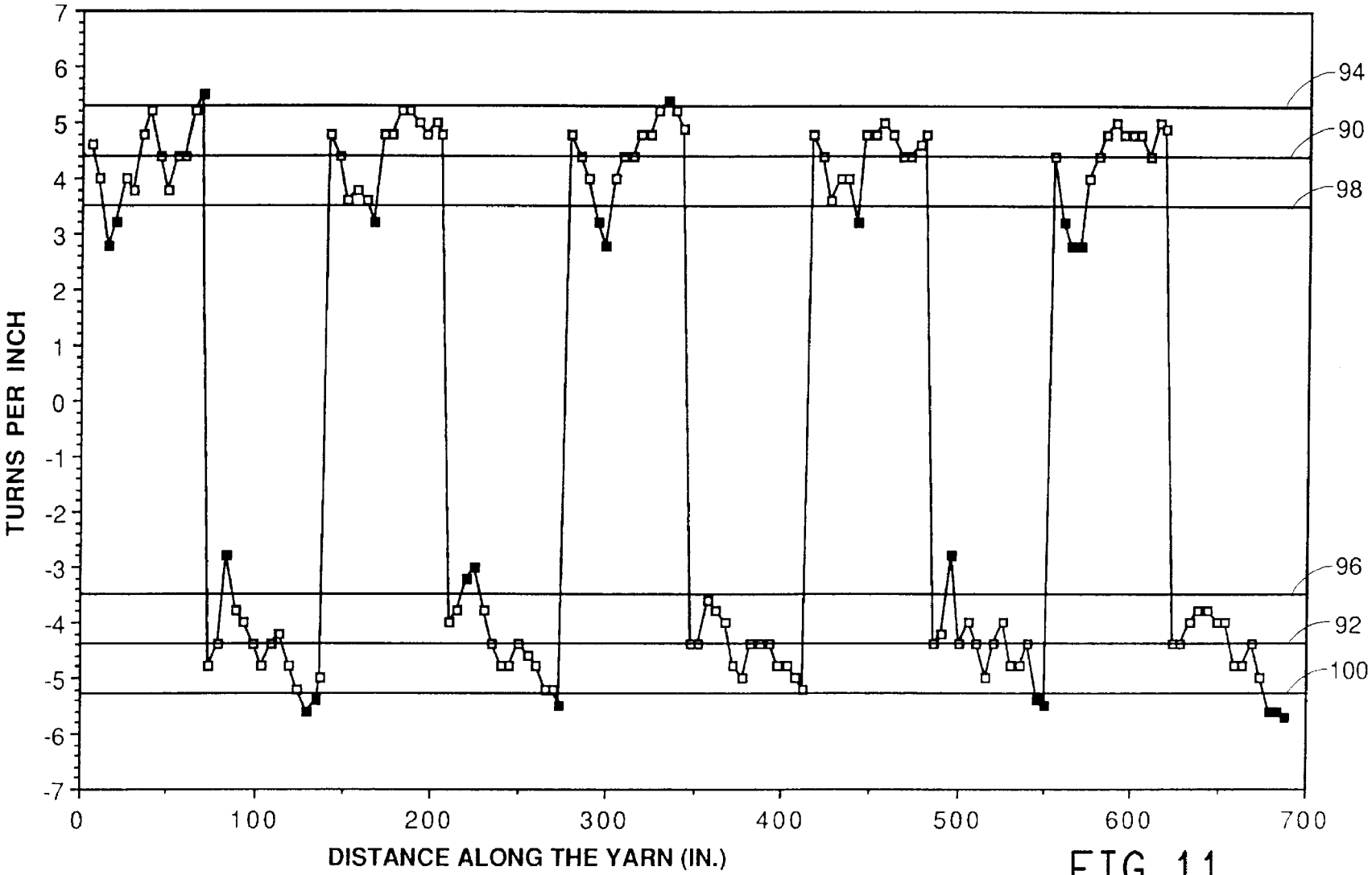
FIG. 11 is a plot of turns per inch (TPI) versus sample length for a sample yarn made without snubbing according to the method of U.S. Pat. No. 4,873,821.

FIG. 10 is a plot of the turns per inch for the 5 inch segments from a 679 inch sample of 5S twist and 5Z twist plies for a two-ply yarn made according to the invention at a high speed of about 260 YPM. The sample was made with a snub similar to that in FIG. 3 and with an additional pin about 24 inches beyond the first ply snub located 7" from the booster jet. The category 1 and 2 defects are defined as data points that deviate from the average TPI for the sample by 20% or more. Line 90 represents the average TPI for the sample plotted on the S ply twist data; line 92 represents the average TPI for the sample plotted on the Z ply twist data. Lines 94 and 96 represents a +20% variation from the average and lines 98 and 100 represent a −20% variation from the average. The darkened data points show variations equal to or greater than 20%; there are 11 such defects in this sample. Comparing this to the sample length, there are 1.6 defects per 100 inches. FIG. 11 is a plot of a 688 inch sample taken at the same high speed, but without snubbing. There are 23 category 1 and 2 defects, or 3.3 defects per 100 inches. A sample made without snubbing even at lower speeds of about 170 YPM still had a category 1 and 2 defect level exceeding 2.7 defects per 100 inches looking at a 505" sample. It can be seen from the data presented that snubbing significantly reduces category 1 and 2 defects even at high speeds.

Figure 12:
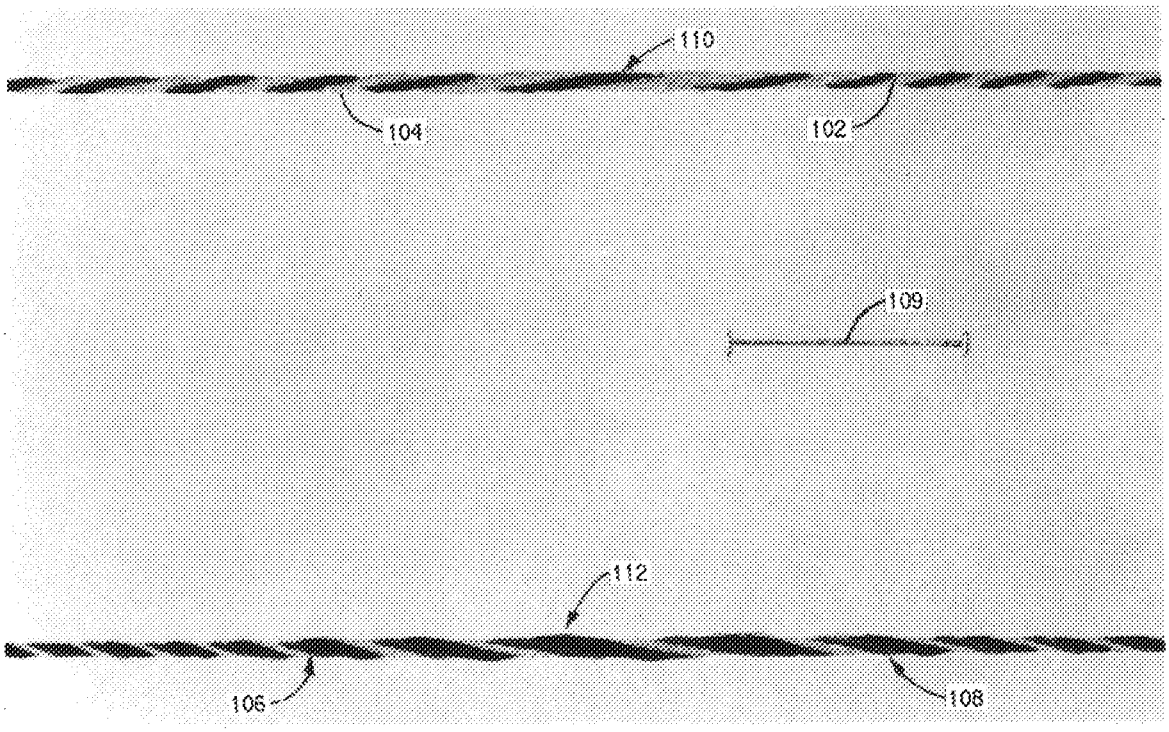
FIG. 12 (PRIOR ART)
FIG. 12 is an enlarged (2×) photo of a yarn sample without snubbing illustrating a "flash" defect.

Category 3 defects are defined by an imbalance in singles twist that may not show up as a low or high ply twist defect. This defect is best detected visually as an irregularity, or "flash", in a section of plied yarn at least 1.5 inches long. The visually detected defect can be confirmed by cutting out the suspected "flash" and actually measuring the singles twist after unplying. If at least one of the yarns has an initial singles twist (before plying, or re-formed singles after unplying) less than ½ the level of the others, and has a residual singles twist (after plying) of less than 1.0 turns per inch, then it is a "flash" defect. FIG. 12 is a photo showing "flash" defects for a sample of two ply yarn 110 and a sample of three ply yarn 112 made according to the prior art method of U.S. Pat. No. 4,873,821. The top yarn is two ply black and white strands where, in the far left and far right of the figure, both strands have acceptable singles twist. Starting at about position 102 and ending at about position 104 the singles twist in the white strand drops to a level less than 1 TPI residual twist and the singles twist in the black strand remains at an acceptable level. The bottom yarn of FIG. 12 is three ply black, white and gray, where in the far left and far right of the figure, all strands have acceptable singles twist. Starting at about position 106 and ending at about position 108, the singles twist in the black strand drops to a level less than 1 TPI residual twist and the singles twist in the white and gray strands remain at acceptable levels. Line 109 is a 1.0 inch reference line. Notice in both the two ply and three ply samples, the low TPI strand appears bulky with the filaments loosely gathered in a ribbon, compared to the other strands where the filaments are compactly bundled. Such "flash" defects are usually anywhere from about 1.5–13.0 inches long. In the case of three ply yarn, one or two strands may have less than 1.0 TPI residual twist. A single "flash" is counted as one defect regardless of its length. When the sample of FIG. 10 was examined for "flashes", none were present, so the total category 1, 2 and 3 defects are $^{1.6}/_{100}$ inches. In the sample of FIG. 11, 21 "flash" defects were present, so the total category 1, 2 and 3 defects are $^{6.4}/_{100}$ inches. The sample made at low speed mentioned earlier had 11 flash defects, so the total category 1, 2, and 3 defects even at low speeds are $^{5.0}/_{100}$ inches. It can be seen from the data presented that snubbing significantly reduces category 3 defects even at high speeds.

The product made according to the method of the invention using snubbing is a unique product not previously achievable over significant lengths of yarn by other known means. The defect level in the new product is less than ½ the best level attainable using known methods for making bonded alternate twist plied yarn, and provides a significant improvement in uniformity over alternate twist plied yarn made by the method of U.S. Pat. No. 4,873,821. In the referenced method, it is suggested that to produce quality yarn, a preferred distance for L1 is 2–3 times Lr. When practicing the snubbing method, surprisingly it was found that this distance could be reduced to about ½ that suggested without sacrificing quality, thereby substantially decreasing the space required for the equipment.

It is believed that the improvement offered by the twist stop means of the invention can be achieved with a variety of yarns, a variety of twisting levels, a variety of reversal lengths, a variety of yarn deniers, and a variety of plies. The different embodiments shown are believed to all achieve the substantial improvement in uniformity in alternate twist plied yarn having a bond in the plies before the ply reversal, wherein the ply twist level, averaged over a plurality of intervals between reversals and measured over a sample length of at least 10 reversals and a length of at least 500 inches, has a defect level less than 2.5 defects per 100 inches, the defect rate including the total of high ply twist, low ply twist, and unbalanced singles twist over the sample length.

Such a uniform alternate ply-twist yarn with a bond in the plies could not be achieved before.

What is claimed is:

1. An alternate twist plied yarn formed from a plurality of strands ply twisted in alternating directions in lengthwise intervals of first half-cycles of ply-twist followed by second half-cycles of ply-twist with reversal nodes therebetween and having an average S ply twist level and an average Z twist ply level measured as the average number of twist plys per inch over a sample length of at least ten consecutive half-cycles and at least 500 inches, there being a bond formed adjacent each node wherein the first half-cycle of ply-twist is located within the bond and the second half-cycle of ply-twist originates at one end of the bond, said alternate twist plied yarn having a defect level in said sample length less than 2.5 defects per 100 inch length of twist plied yarn, said defect rate including the total of high ply twist defects, low ply twist defects, and unbalanced singles twist defects over said sample length.

* * * * *